United States Patent [19]

Ishimoto

[11] Patent Number: 4,898,562

[45] Date of Patent: Feb. 6, 1990

[54] DIRECTION-COVERTING DEVICE FOR A REMOTE-CONTROLLED TOY

[75] Inventor: Zenichi Ishimoto, Tokyo, Japan

[73] Assignee: Nikko Co., Ltd., Tokyo, Japan

[21] Appl. No.: 221,467

[22] Filed: Jul. 19, 1988

[30] Foreign Application Priority Data

Sep. 12, 1987 [JP] Japan ..... 62-227559

[51] Int. Cl.[4] ..... A63H 17/385

[52] U.S. Cl. ..... 446/460; 446/468

[58] Field of Search ..... 446/129, 133, 437, 454, 446/455, 456, 460, 461, 462, 468, 484; 273/86 B; 335/272

[56] References Cited

U.S. PATENT DOCUMENTS

| | | | |
|---|---|---|---|
| 3,201,661 | 8/1965 | Koutnik | 335/272 |
| 3,743,898 | 7/1973 | Sturman | 335/268 |
| 3,774,340 | 11/1973 | Barlow et al. | 446/455 |
| 4,319,823 | 3/1982 | Hashimoto | 335/272 |
| 4,471,566 | 9/1984 | Ishimoto | 446/460 |
| 4,571,213 | 2/1986 | Ishimoto | 446/129 |
| 4,755,161 | 7/1988 | Yang | 446/460 |

FOREIGN PATENT DOCUMENTS

| | | | |
|---|---|---|---|
| 24240 | 2/1981 | European Pat. Off. | 446/460 |
| 2223033 | 11/1973 | Fed. Rep. of Germany | 446/456 |
| 2950161 | 3/1981 | Fed. Rep. of Germany | 446/456 |
| 94696 | 8/1959 | Norway | 335/272 |
| 708469 | 5/1954 | United Kingdom | 446/462 |
| 2199257 | 7/1988 | United Kingdom | 446/129 |

*Primary Examiner*—Mickey Yu

*Attorney, Agent, or Firm*—Young & Thompson

[57] ABSTRACT

A direction-converting device for a remote-controlled toy is disclosed wherein a rotor shaft is supported between the opposite contact faces of coil bobbins of an equally divided electromagnetic coil, said each bobbin accommodating a rotor magnet rotatably in a hollow inside and being wound in parallel with the rotor shaft in multiple turns with coils to form an electromagnetic coil assembly, and said rotor shaft at its one end communicating through a crank with a controlling element for shifting the direction so as to allow the electromagnetic coil to control the magnetic polarity of the rotor magnet by means of a remote control system.

3 Claims, 3 Drawing Sheets

DIRECTION-COVERTING DEVICE FOR A REMOTE-CONTROLLED TOY

FIELD OF THE INVENTION

This invention relates to a direction-converting device for a remote-controlled toy.

BACKGROUND OF THE INVENTION

As a direction-converting device for a radio-controlled running toy and the like, there is known a device in which a steering plate mounted on front wheels is turned to the left or the right through a worm gear mechanism by reversible operation of a servo motor for converting the direction of the front wheels to the straight, the right or the left.

In the direction-converting device thus constructed, however, frequent changes in the direction of the running toy may require frequent reverting operations of the servo motor, thereby generating sparks at various contacts forming an electrical system of the servo motor. Such sparks in the servo motor may cause damage to the electrical system of the servo motor and erroneous operation of the wireless controller. In particular, the servo motor is undesirably expensive in spite of its excellent control performance and greater expense is required for designing a control circuit to avoid the sparks.

In view of the foregoing, the applicant has already devised a direction-converting device which comprises an electromagnet energizable to a different polarity in accordance with a given instruction and a controlling element swingably supported at a predetermined distance apart from the electromagnet and provided at its swingable end with a pair of magnets of different polarities corresponding to the electromagnet but without contact therewith, said controlling element being engaged with a steering plate at its swingably shifting portion to shift the controlling element to the desired direction through attractive or repulsive relation to each magnet provided at the controlling element, depending on the energized state of the electromagnet, so that it may be of small size, superior in efficiency and very low in manufacturing cost, and accordingly obtained Japanese Pat. No. 1330571 (the Japanese Patent Publication No. 60-52827) directed thereto.

With regard to the direction-converting device operating through attraction or repulsion between the electromagnet and the magnets as described hereinbefore, however, in a small-sized running toy, the shift quality of the steering plate is small and the shift load thereof is also small, so that a whole device may be of small size with excellent efficiency, thereby reducing the manufacturing cost. In a comparatively large-sized running toy, on the other hand, the shift quality of the steering plate is larger and the shift load thereof is also larger. Then, the hereinbefore-described direction-converting device, when used, requires larger electromagnet and magnets, resulting in an increase in weight as well as in consumption of electric power for power-up. Furthermore, the use of attractive or repulsive relation between an electromagnet and magnets leads to a speedy shift of the steering plate simultaneously when the electromagnet is energized, resulting in disadvantages such as the impossibility of smooth steering control in a high speed running.

SUMMARY OF THE INVENTION

Accordingly, an object of the invention is to provide a direction-converting device for a comparatively large-sized remote-controlled toy capable of smoothly converting the direction as well as being simple and lightweight in construction, with reduced consumption of electric power and low manufacturing cost.

In accordance with the invention there is provided a direction-converting device for a remote-controlled toy wherein a rotor shaft is supported between the opposite contact faces of coil bobbins of an equally divided electromagnetic coil, said each bobbin accommodating a rotor magnet rotatably mounted in its hollow inside and being wound in parallel with the rotor shaft in multiple turns with coils to form an electromagnetic coil assembly, and said rotor shaft at one end communicating through a crank with a controlling element for shifting the direction so as to allow the electromagnetic coil to control the magnetic polarity of the rotor magnet by means of a remote control system.

In the hereinbefore described direction-converting device, the controlling element, which is supported at its one end and engaged with an eccentric shaft of the crank at the other end, is associated with steering rods respectively at its swingable side portions.

Furthermore, the device may include a pair of supporting rods which holds part of the controlling element at its one end and is swingably fixed at its other end, said supporting rods at their one end being connected together through a spring, while said supporting rods at their middle portions are connected to a positioning element for determining a neutral position of the controlling element and provided with a neutral position retaining means for holding it.

The remote controlled toy may be preferably applied to a remote controlled running toy controllable by steering the wheels.

The direction-converting device according to the invention is provided with a rotor magnet of two polarities in the center of an electromagnetic coil wound in the predetermined direction to exchange an energized state of the electromagnetic coil or the direction of electric current supplied to the electromagnetic coil, thereby changing the magnetic polarity energizable to the rotor magnet to reliably turn the rotor magnet within the extent of ± 90 degrees.

Accordingly, the application of rotating power of the rotor magnet thus constructed as operating power of the direction-converting device of a remote-controlled toy results in a smooth control suitable for a slow shift and a comparatively large load.

The invention will be described in more detail hereinafter for its preferred embodiments with reference to the accompanying drawings.

PREFERRED EMBODIMENTS OF THE INVENTION

Figure 1:
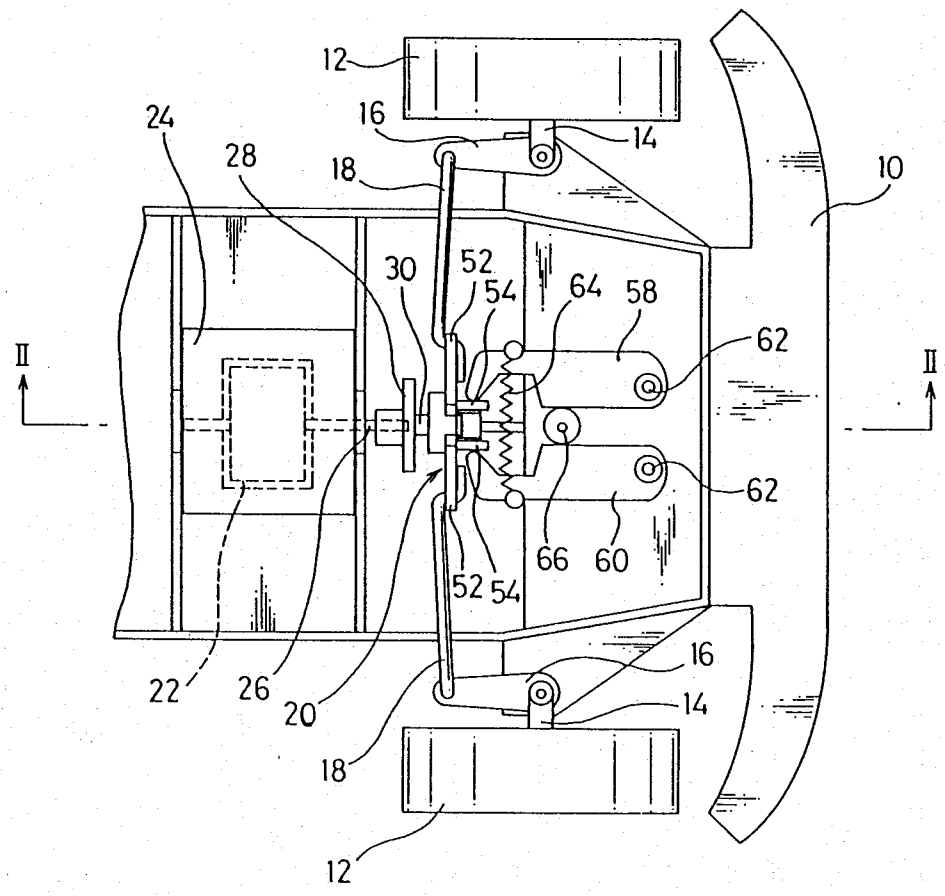
FIG. 1 is a plan view of the main portion of the car structure of a remote-controlled running toy having the direction-converting device according to the invention.

FIG. 1 shows one embodiment of the car structure of a running toy including the remote control system according to the invention.

Referring to FIG. 1, a numerical reference 10 represents a front portion of a car base while a reference 12 represents front wheels. A pair of wheels 12, 12 are respectively arranged at predetermined positions of the car base 10 through a link element 16 integrally provided at one end of an axle 14. Further, the link element 16 is swingably coupled to one end of a steering rod 18, while a pair of steering rods 18, 18 at their other end are connected to a swingable controlling element 20.

In accordance with the invention, a driving means of the controlling element 20 includes an electromagnetic coil assembly 24 including a rotor 22 which comprises a crank 28 at one end of a rotor shaft 26 of the rotor 22. Accordingly, an eccentric shaft 30 of the crank 28 is engaged with the swingable end side of the controlling element 20 (see FIG. 2). The electromagnetic coil assembly 24 according to the invention comprises an upper electromagnetic coil 32 and a lower electromagnetic coil 34 composed of coil bobbins 36, 38 each having semi-cylindrical rotor containers 40, 42 at their opposite central portions and bearing holes 44, 44 at their opposite faces. The bearing hole 44 of the electromagnetic coil assembly 24 thus constructed is engaged with the rotor shaft 26, while the rotor containers 40, 42 rotatable contains a rotor magnet 22 (See FIG. 3).

Figure 2:
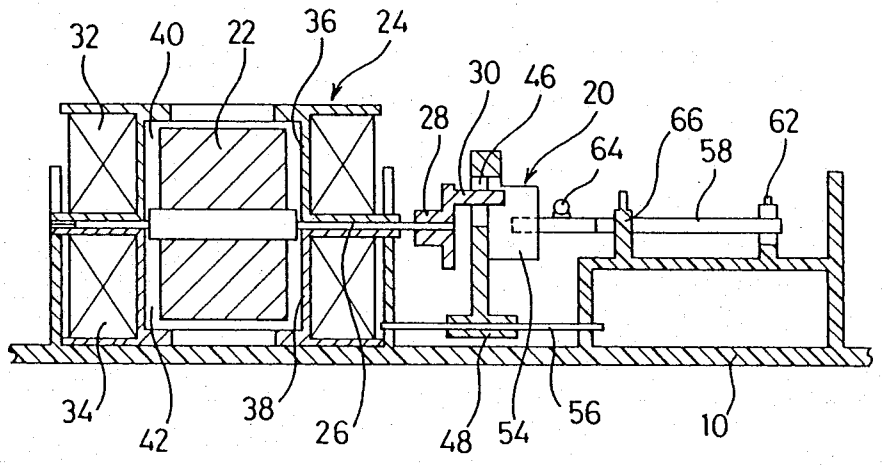
FIG. 2 is an enlarged sectional view of the main portion taken along II—II of FIG. 1.

The rotor magnet 22 thus constructed energizes the electromagnetic coil assembly 24 to generate a rotation effect in a fixed direction. Then, in this embodiment, the rotor shaft 26 is associated with the crank 28 to engage with the controlling element 20 as shown in FIGS. 2 and 3.

Figure 3:
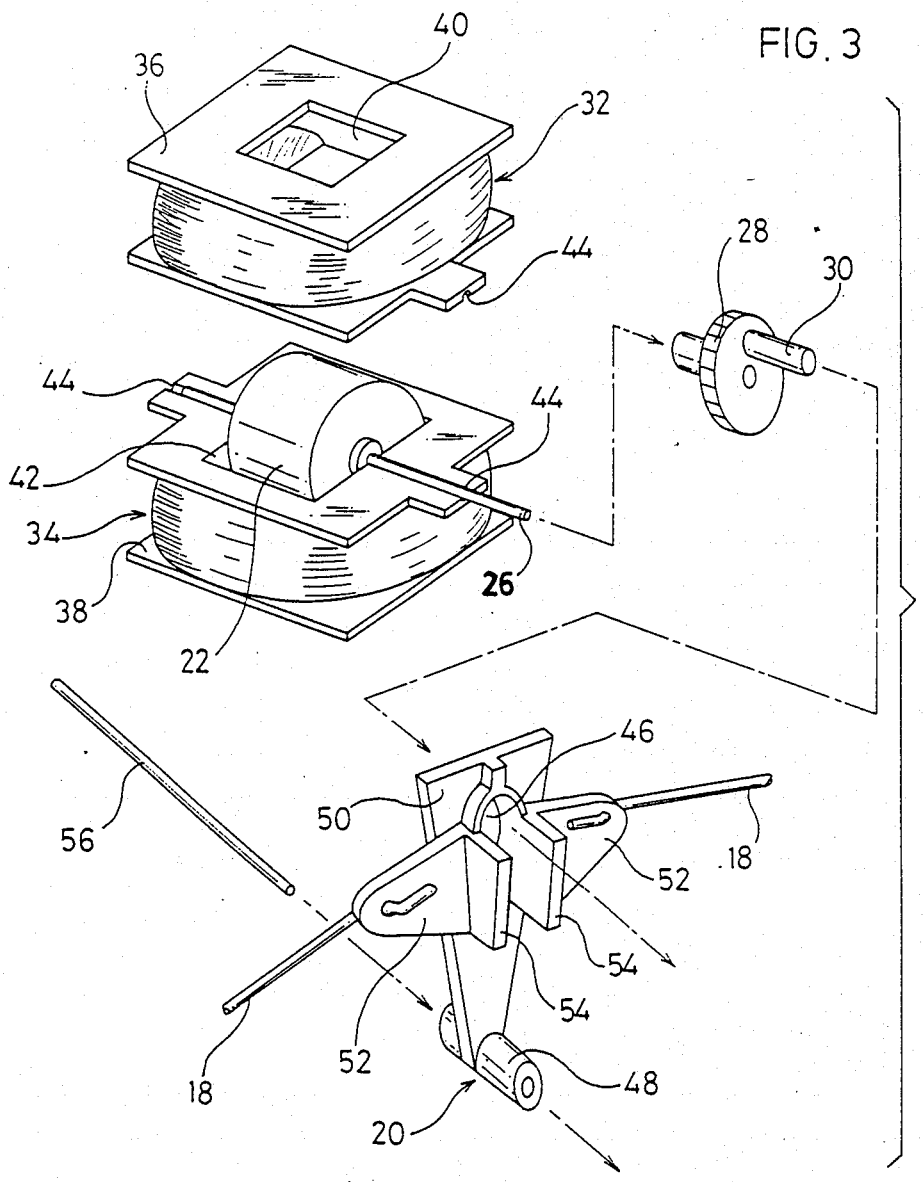
FIG. 3 is a disassembled perspective view of a controlling element structure comprising a main portion of the device according to the invention and an assembled state of the driving mechanism thereof.

The controlling element 20 in this embodiment, as shown in FIG. 3, is provided protrudingly with an engagement hole 46 for engaging with the eccentric shaft 30 of the crank 28 and further with a swingable plate 50 having a bearing cylinder 48 at its lower end. The swingable plate 50 at its upper end side is protrudingly provided with wing pieces 52, 52 for coupling the steering rods 18, 18 respectively at both sides around the engagement hole 46 and further provided with a pair of engagement pieces 54, 54 extending in parallel in the right-angled direction from the bases of the wing pieces 52, 52. In the controlling element 20 thus constructed, a supporting shaft 56 is inserted into the bearing cylinder 48 to preferably fix the both ends of the supporting shaft at the car base 10, while the eccentric shaft 30 of the crank 28 is engaged with the engagement hole 46 (See FIG. 2). Consequently, the swingable plate 50 corresponds with the rotating direction of the rotor shaft 26 to swing to the right or the left with the supporting shaft as a support. Subsequently, the steering rods 18, 18 shift to turn the wheels 12, 12 to the right or the left.

Furthermore, this embodiment is provided with a means for automatically keeping the controlling element 20 at its neutral position. Namely, the means, as shown in FIG. 1, is provided with a pair of supporting rods 58, 60 at their one end interposing the engagement pieces 54, 54 attached to at the controlling element 20 on their both sides, while the supporting rods 58, 60 each at their other end are engaged with protrusions 62, 62 mounted at the car base 10 to be swingably fixed. Moreover, the supporting rods 58, 60 at their swingable end side are elastically connected through a spring 64, while the middle positions thereof are lie adjacent a positioning element 66 for defining a neutral position and protrudingly provided at the car base 10 to interpose it. From such a structure, when the controlling element 20 shifts to the right or the left under the action of the electromagnetic coil assembly 24, either of the supporting rods 58, 60 swings against the spring elasticity 64, resulting in a smooth steering control. When energization to the electromagnetic coil assembly 24 is released, the controlling element 20 is free and immediately returned to a predetermined neutral position by elastic interposing action of the supporting rods 58 60.

As is apparent from the hereinbefore described embodiment, the invention, when applied to a running toy by means of remote control systems such as radio-control, may change the energized state of the electromagnetic coil by two different instruction signals, thereby controlling the turning direction of the wheels to the right or the left.

Particularly in the direction-converting device according to the invention, the rotor magnet is so constructed that both of its outer circumferential faces are symmetrically of different polarities around the rotor shaft and is accommodated in the electromagnetic coils divided in two, so that depending on the direction of the electric current supplied to the electromagnetic coils, the energized polarity is changed to reliably turn the rotor magnet at ± 90 degrees. The electromagnetic coils are equally divided and wound in many multiples on the outer circumference of the rotor magnet in parallel with the rotor shaft, thereby generating sufficient electromagnetic energy with such a simple structure. Especially, the electromagnetic coils, when energized, may give a predetermined energized polarity to the rotor magnet to rotate slowly as well as powerfully, thereby smoothly achieving a steering control with large load. Namely, the steering control for a comparatively large-sized running toy at high speed may be easily carried out.

Therefore, according to the invention, the operation of the controlling element may reliably be carried out by means of rotary power of the rotor energized by the hereinbefore described electromagnetic coil Furthermore, a neutral position retaining means connected with the controlling element may never affect the operation of the controlling element. Rather, the restoration to a neutral position when released from energization of the electromagnetic coil may be securely carried out through a mechanism compactly constructed.

Moreover, the device according to the invention is simple in construction as well as easy to assemble each constituent part, resulting in a low manufacturing cost, while the mechanism comprising an electromagnetic coil and a rotor magnet results in a smooth steering control as well as an efficient control operation with economical consumption of electric power.

The present invention is not only suitable for the direction-converting devices of running toys by means of radio-control system from small size to large size or the other remote control system but also applicable to various remote-controlled toys with the direction-converting function other than the running toys.

Although the invention has been described hereinbefore with its preferred embodiments, it will be appreciated that many variations and modifications may be made without departing from the spirit and scope of the invention.

What is claimed is:

1. A direction-shifting device for a remote-controlled toy, said device comprising a rotor shaft supported between opposite contact faces of opposing coil bobbins of an equally-divided electromagnetic coil, each said bobbin comprising a coil wound in multiple turns parallel to said rotor shaft, said rotor shaft supporting a rotor magnet, each said bobbin including a hollow interior within which is located a portion of said rotor magnet, an end of said rotor shaft being connected to a crank having an eccentric shaft, and direction-shifting means engaged with said eccentric shaft of said crank, said direction-shifting means being pivotably supported and displaceable by said eccentric shaft in a lateral direction and connected at lateral portions thereof with opposing steering rods to accomplish a desired shift in direction upon displacement of said direction-shifting means.

2. The direction-shifting device of claim 1, further including positioning means to maintain said direction-shifting means centrally-positioned in a neutral position with regard to said rotor shaft, said positioning means comprising spring bias means to maintain said direction-shifting means centrally-positioned when said direction-shifting means is not laterally-displaced by said eccentric shaft of said crank.

3. The direction-shifting device of claim 2, wherein said positioning means includes opposed spring-biased positioning elements, one end of each said elements being pivotably mounted and adjacent opposite ends of said elements being connected together by spring means, said opposite ends each adapted to engage said direction-shifting means so as to urge said direction-shifting means toward said neutral position, said positioning means further including means to define said neutral position comprising a fixed surface between said positioning elements and which maintains a predetermined minimum distance between said positioning elements, said elements being urged toward said fixed surface by said spring means.

* * * * *